US005474466A

United States Patent [19]

Sakuraoka et al.

[11] Patent Number: 5,474,466

[45] Date of Patent: Dec. 12, 1995

[54] ELECTRIC CONNECTOR HAVING IMPROVED LOCKING CONSTRUCTION

[75] Inventors: Masahiko Sakuraoka; Kyoichiro Kawano, both of Kawasaki, Japan

[73] Assignee: Fujitsu Limited, Kawasaki, Japan

[21] Appl. No.: 214,575

[22] Filed: Mar. 18, 1994

[30] Foreign Application Priority Data

Jul. 8, 1993 [JP] Japan ..... 5-169376

[51] Int. Cl.[6] ..... H01R 13/62

[52] U.S. Cl. ..... 439/319; 439/582

[58] Field of Search ..... 439/314, 316, 439/319, 578–585, 317, 318, 311, 824, 63

[56] References Cited

U.S. PATENT DOCUMENTS

| | | | |
|---|---|---|---|
| 3,049,690 | 8/1962 | Sparber | 439/319 |
| 3,136,592 | 6/1964 | Miller | 439/314 |
| 3,287,031 | 11/1966 | Simmons et al. | 439/319 |
| 4,684,200 | 8/1987 | Capp | 439/578 |
| 4,746,305 | 5/1988 | Nomura | 439/319 |

FOREIGN PATENT DOCUMENTS 1-276576 11/1989 Japan .

*Primary Examiner*—Gary F. Paumen
*Assistant Examiner*—Hien D. Vu
*Attorney, Agent, or Firm*—Nikaido Marmelstein Murray & Oram

[57] ABSTRACT

A plug includes an inner pipe in which an external electric cable is installed; and an outer pipe supporting the inner pipe therein via an elastic member such that the inner pipe can move in the outer pipe in a withdrawal direction, the outer pipe being provided with a first locking portion for locking the plug to the socket. A socket accompanied by an electric circuit, the inner pipe being inserted into the socket so that the electric circuit is electrically connected to the electric cable, the inserting being performed in an inserting direction opposite to the drawing-out direction. A fixed block fixed to a base on which the socket is also fixed, however the construction consisting of the fixed block, socket and base is made so that an external force applied to the fixed block cannot be directly applied to the socket, the fixed block being provided with a second locking portion to be fitted to the first locking portion so that the plug is locked to the fixed block.

5 Claims, 5 Drawing Sheets

ELECTRIC CONNECTOR HAVING IMPROVED LOCKING CONSTRUCTION

BACKGROUND OF THE INVENTION

1. Field of the Invention

The present invention relates to an electric connector and particularly to a connector having a withdrawal preventing locking mechanism.

The recent electronic equipment having high-speed data transferring ability demands coaxial connectors to be equipped thereto to enable high-speed data transfer. For this purpose, coaxial connectors having improved insertion/drawing-out operation convenience and good withdrawal preventing ability have been provided.

However, such high-speed data transfer requirement requires a relevant electric cable to be thickened (outer diameter being enlarged) and such a thick cable having a heavy weight accordingly may apply a large tension force thereto, the large tension force causing the external force applied to the relevant connector to be increased accordingly.

The connector is required to provide a high electricity conducting reliability even when a large external force is applied to the relevant connector.

2. Prior Art

Japanese Laid-Open Patent Application No. 1-276576 discloses a connector having a withdrawal preventing mechanism for example as shown in FIGS. 1A, 1B and 1C. The connector consists of the plug 2 and socket 1. FIG. 1A shows the connector in a condition before the plug 2 is inserted into the socket 1. FIG. 1B shows the connector in a condition during the time the plug 2 is being inserted into the socket 1. FIG. 1C shows the connector in a condition where the plug-socket insertion is completed so that the locking between the plug 2 and socket 1 is established.

The plug 2 is provided with an insulating element 4 supporting a male contact 3 in the center of the plug 2; and a plug shell 5 provided around the insulating element 4. The plug shell 5 is provided with a groove 7 throughout the entire circumference thereof, the groove 7 being used to lock the plug 2 to the socket 1.

The socket 1 consists of a socket body including a cable supporting member 9 including an approximately cylindrical insulating element 8 and a metal shell 10; and a cylindrical slidable sleeve 11 provided around the socket body and forward/backward slidable.

The insulating element 8 supports a female contact 12 in the center thereof. The cable supporting member 9 is installed on a coaxial cable 14, to be connected to the circuit accompanied by the plug 2. The insulating element 8 is located at the front of the cable supporting member 9. The metal shell 10 having an approximately cylindrical shape is screwed onto and thus fixed to the cable supporting member 9.

An inserting portion 6 of the plug 2 is inserted into the front end of the metal shell 10. The metal shell is provided with slits creating a plurality of segments 16 inwardly transformable due to its elasticity. The slidable sleeve 11 is provided with an establishing portion 17 extending inside from the front-end (right in the figure) backwards (left in the figure), the inner diameter of which portion is smaller than the front-end outer diameter of the metal shell 10.

The socket 1 is formed as follows: The cable supporting member 9 is screwed onto and thus fixed to the metal shell 10; then the metal shell 10 is forward inserted into the slidable sleeve 11; and a ring spring 19 having the shape of the Greek letter Ω is installed on the slidable sleeve 11 using a spring installation groove 18.

In FIG. 1A, since the slidable sleeve 11 is located toward the rear of the metal shell 10, the segments 16 have not been transformed inwardly, that is, the segments are in the open state. As a result, the force required to be applied to the connector so as to insert the plug 2 into the socket 1 can be reduced, easy inserting being thus achieved.

After the operator inserts the plug 2 into the socket 1 so as to place the connector in a predetermined spatial state, the operator should cause the slidable sleeve 11 to slide forward so as to place the connector in the spatial state shown in FIG. 1C. Since the slidable sleeve 11 is provided with the establishing portion 17 as described above, the forward sliding of the sleeve 11 causes the segments 16 to move inside so as to be engaged with the metal shell securely. This engagement prevents (locks) the plug 2 from being drawn out from the socket 1.

If the operator intends to draw out the plug 2 from the socket 1, the operator should cause the slidable sleeve 11 to move backward. As a result, the engagement of the segments 16 with the metal shell 10 may be released and the plug 2 may be drawn out from the socket 1. Thus, the force required to be applied to the connector so as to draw out the plug 2 from the socket 1 can be reduced, easy drawing out being thus achieved.

However, a certain problem may occur in such a connector in the prior art, due to the construction where the plug 2 is directly locked to the socket 1. Accordingly, an external force applied to the connector almost directly affects the electrically conducting portion therein. The external force applied may be a large one due to the thickening the cable 14 as described above.

Concretely, some instability may appear in the electrically conducting portion between the male contact and female contact in the connector, the electrical conduct being thus degraded or ineffective. Further, in a case where the electrical circuit accompanied by the plug 2 is fixed on a circuit substrate or the like through soldering, the soldering connection may be ineffective due to the large external force being applied to the connector. Thus, the reliability may be reduced due to the thickening of the cable 14 in the prior art.

SUMMARY OF THE INVENTION

An object of the present invention is to provide a connector providing high reliability therein even if a thick and thus heavy cable is used therewith.

To achieve this object of the present invention, a connector according to the present invention comprises:

a plug and socket pair for electrically connecting at least two electric circuits with one another; and a locking mechanism for locking the plug to the socket in said plug and socket pair, said locking mechanism comprising a construction for protecting the electric connection made between said two electric circuits from being adversely affected by a force externally applied to said plug and socket pair, the protection being achieved by preventing said force from being directly applied to said electric connection made between said two electric circuits.

Concretely, the connector comprises:

a plug including an inner pipe in which an external electric cable is installed; and an outer pipe supporting said inner pipe therein via an elastic member such that said inner pipe can move in said outer pipe in a withdrawal direction, said outer pipe being provided with a first locking portion for locking said plug to said socket;

a socket accompanied by an electric circuit, said inner pipe being inserted into said socket so that said electric circuit is electrically connected to said electric cable, the inserting being performed in an inserting direction opposite to said withdrawal direction; and a fixed block fixed to a base on which said socket is also fixed, however the construction consisting of said fixed block, socket and base being made so that an external force applied to said fixed block cannot be directly applied to said socket, said fixed block being provided with a second locking portion to be fitted to said first locking portion so that said plug is locked to said fixed block.

In the connector having the above construction, the relevant electrical connection between the electrical circuits of the plug and socket is established due to the inner pipe being inserted into the socket. The mechanical connection between the plug and socket is established due to the outer pipe being fasten to the fixed block, the securing being performed due to the first and second locking portion being locked to one another.

In the construction, the external force applied to the plug due to a thick and heavy cable's thus increased tension force for example is borne not directly by the socket but by the fixed block.

Accordingly, the connection between the inner pipe and the socket ought not to be greatly affected by such an external force, the relevant electric conduction being thus ensured. Also, even in a case where soldering connection is employed for the socket electric circuit to be fixed on a circuit substrate, the soldering connection can be prevented from being ineffective even due to the external force being applied to the plug. Thus, the reliability of the connector can be improved.

Other objects and further features of the present invention will become more apparent from the following detailed description when read in conjunction with the accompanying drawings.

DESCRIPTION OF THE PREFERRED EMBODIMENT

Figure 1A:
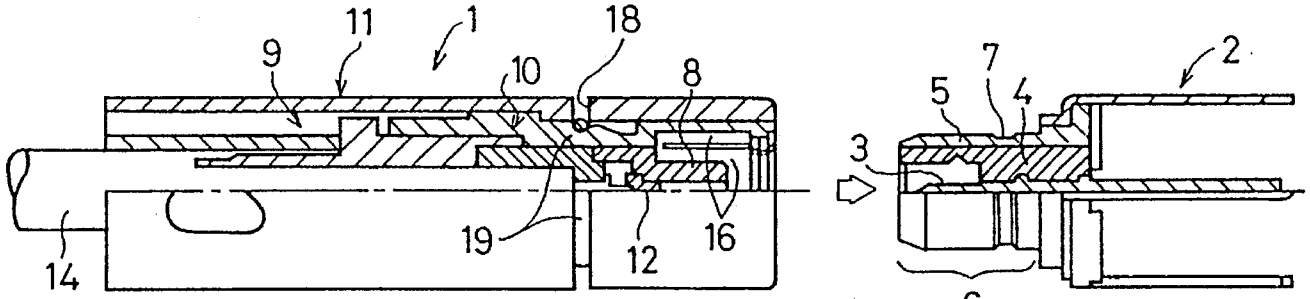
FIG. 1A PRIOR ART
FIGS. 1A, 1B and 1C show side views with partial sectional views of a connector in the prior art.
Figure 1B:
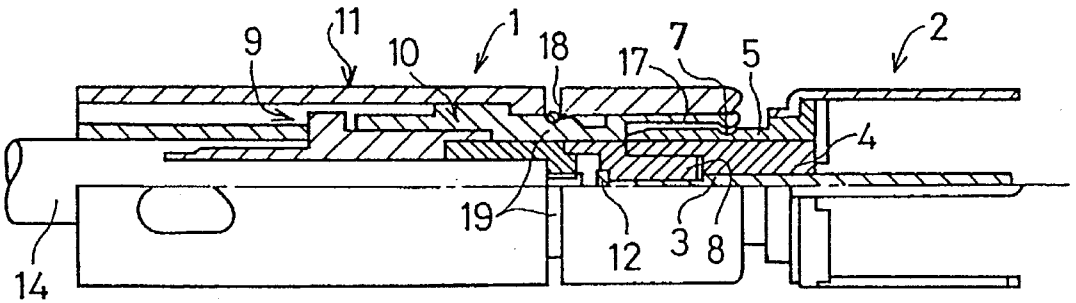
FIG. 1B PRIOR ART
Figure 1C:
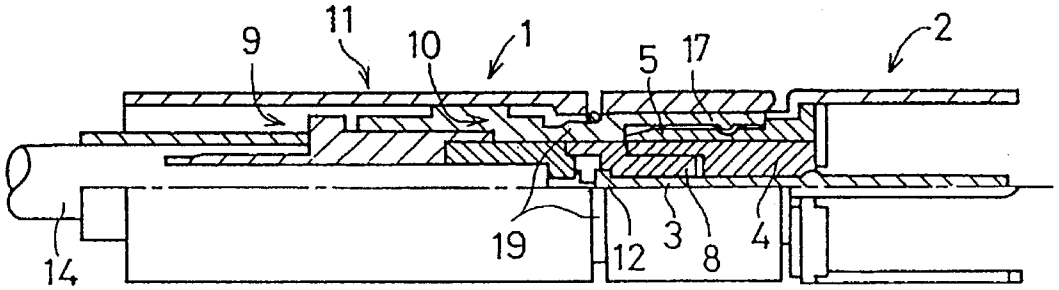
FIG. 1C PRIOR ART

A connector 30 in an embodiment of the present invention is a round type connector to be used for connecting a coaxial cable 31 to a given device. The connector 30 essentially includes plug 32, socket 33 and fixed block 34.

The plug 32 is provided with outer pipe 35, inner pipe 36 provided inside the outer pipe 35, coil spring 37, metal shell 38. Both the inner and outer pipes 36 and 35 are cylindrically shaped and made from solid resin or metal. Since the outer diameter of the inner pipe 36 is smaller than the inner diameter of the outer pipe 35, the inner pipe 36 can freely move in the outer pipe 35 in both the inserting and withdrawal directions A1 and A2 shown in the figure.

A collar 39 is formed to project inside from the inner wall of the outer pipe 35. Collars 40 and 41 are formed to project outside from the outer wall of the inner pipe 36. The collar 40 of the inner pipe 36 is located so that the collar 40 is engaged with the collar 39 of the outer pipe 35 as a result of the inner pipe 36 moving in the A1 direction. The coil spring 37 is inserted between the collar 39 of the outer pipe 35 and the collar 41 of the inner pipe 36.

The coil spring 37 comprises one which produces an elastic force tending to increase the distance between the collars 39 and 41. The inner pipe 36 is held at the position shown in FIG. 2 due to the engagement between the collar 40 of the inner pipe 36 and the collar 39 of the outer pipe 35. Therefore, the inner pipe 36 may move in the A2 direction from the state shown in FIG. 2, due to the A2-direction force being applied to the inner pipe, against the elastic force of the coil spring 37.

The metal shell 38 is used so that the coaxial cable 31 is inserted into and fixed to the shell 38, and the shell 38 is fixed to the inner pipe 36, the shell 38 thus moving together with the inner pipe 36 as a unit. A connection portion 42 is formed at the inserting (A1) (front) end of the metal shell 38 and is fitted into the socket 33.

A pair of first locking portions 43 are formed diametrically opposed at the inserting end of the outer pipe 35. Each of the first locking portions 43 has an approximately L-letter shaped cutout as shown in the figure and has a construction such that each of the below-described second lock portions 44 of the fixed block 34 may be fitted into a respective one of the first locking portions 43. The cutout of each of the first locking portions 43 has a shape as follows: The cutout extends in the A2 direction from the inserting-direction end of the outer pipe 35 for a certain length; then extends in a direction perpendicular to A2 by a certain length; then slightly extends in the A1 direction. The slightly extending portion is referred to a fit position 45.

Figure 4:
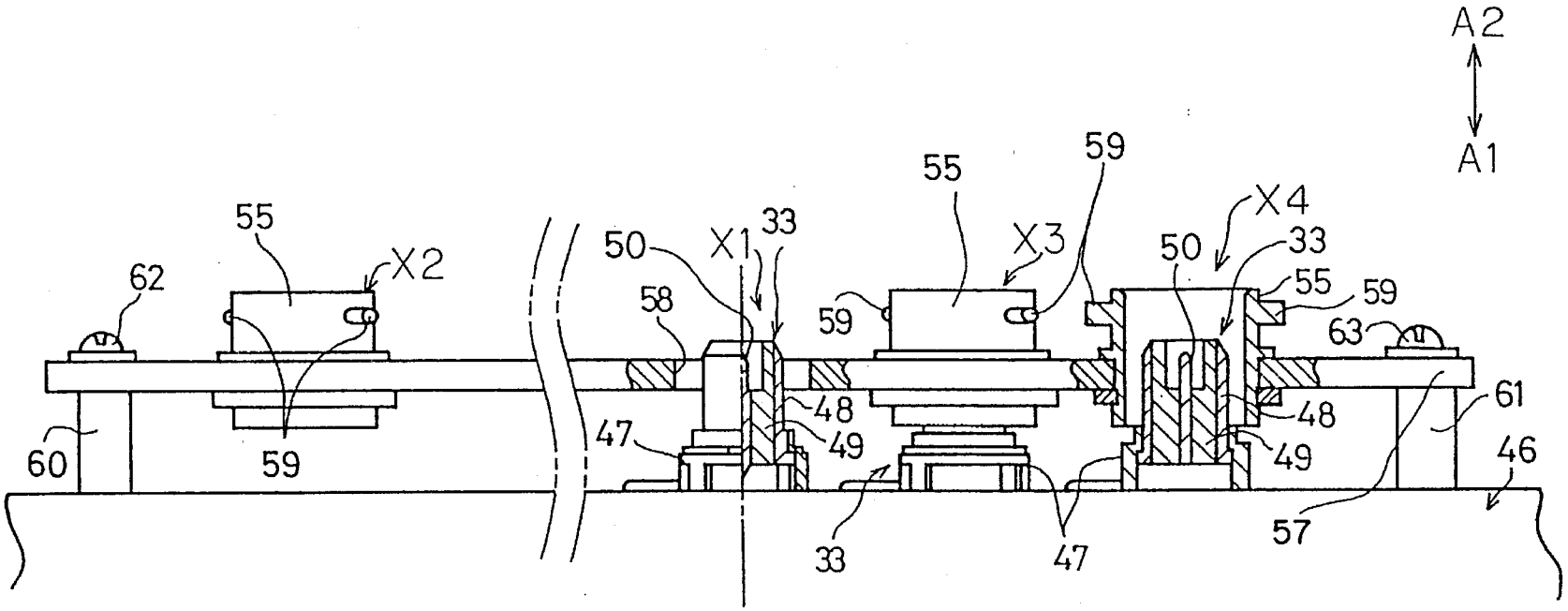
FIG. 4 shows side views and side sectional views of an engagement portion, the socket, and the combination of the engagement portion and socket of the connector of FIG. 2.

The socket 33 and fixed block 34 are described with reference to FIGS. 2 and 4. FIG. 4 shows, for the sake of easy understanding of the respective constructions, the construction X1 where the socket 33 alone is disposed; the construction X2 where the fixed block 34 alone is disposed; the constructions X3 and X4 where both the socket 33 and fixed block 34 are disposed.

The socket 33 is disposed on a circuit substrate 46 and includes base 47, metal shell 48, insulating member 49, connector pin 50, and terminal pins 51 and 52. The base 47 is placed on the circuit substrate 46 and supports the metal shell 48 firmly. The connector pin 50 extends upward from inside the metal shell 48 and the insulating member 49 is inserted between the metal shell 48 and the connector pin 50. The connector pin 50 is electrically connected to the conductor element in the .coaxial cable 31 in a condition where the plug 32 has been inserted into the socket 33.

The terminal pins 51 and 52 respectively extend in the A1 direction from the bottom surface of the base 47. The terminal pins 51 and 52 respectively pass through holes formed in the circuit substrate 46 and project at the rear side of the circuit substrate 46. The thus projecting ends of the pins 51 and 52 are electrically connected to the circuit substrate 46 using solder 54 indicated as dotted areas in FIG. 2. Thus, the socket 33 is fixed onto the circuit substrate 46 and the terminal pin 52 is electrically connected to the connector pin 50.

The fixed block 34, having a cylindrical shape, is disposed on a fixed plate 57 fixed on the circuit substrate 46. The fixed block 34 includes: engagement portion 55 for being engaged to the outer pipe 35 of the plug 32; insertion portion 56 for being inserted into a hole 58 formed in the fixed plate 57; and the pair of second locking portions 44 projecting outward from the outer wall of the engagement portion 55.

The fixed plate 57 is fastened by screws 62 and 63 on bosses 60 and 61 fixed on and upward extending from the circuit substrate 46 so that the fixed plate 57 faces and is spaced apart from the circuit substrate 46. The hole 58 formed in the fixed plate 57 is positioned so as to match the location of the socket 33 and the insertion portion 56 of the fixed block 34 is inserted into the hole 58. Fitting of a C-washer 64 on a portion of the insertion portion 56 projecting from the rear surface of the fixed plate 57 causes the fixed block 34 to be firmly fixed on the fixed plate 57.

Since the fixed plate 57 is thus fixed being spaced apart from the circuit substrate 46, the fixed block being fixed on the fixed plate 57 faces and is located above and apart from the socket 33. Thus, the fixed block 34 is isolated from the socket 33 while the metal shell 48 of the socket 33 is located inside the fixed block 34 in the present embodiment.

The pair of the second locking portions 44 provided on the engagement portion 55 located on the periphery of the fixed block 34 comprise pins as shown in the figures and match the disposition of the pair of the first locking portions 43.

Operation of the connector 30 is described.

Figure 2:
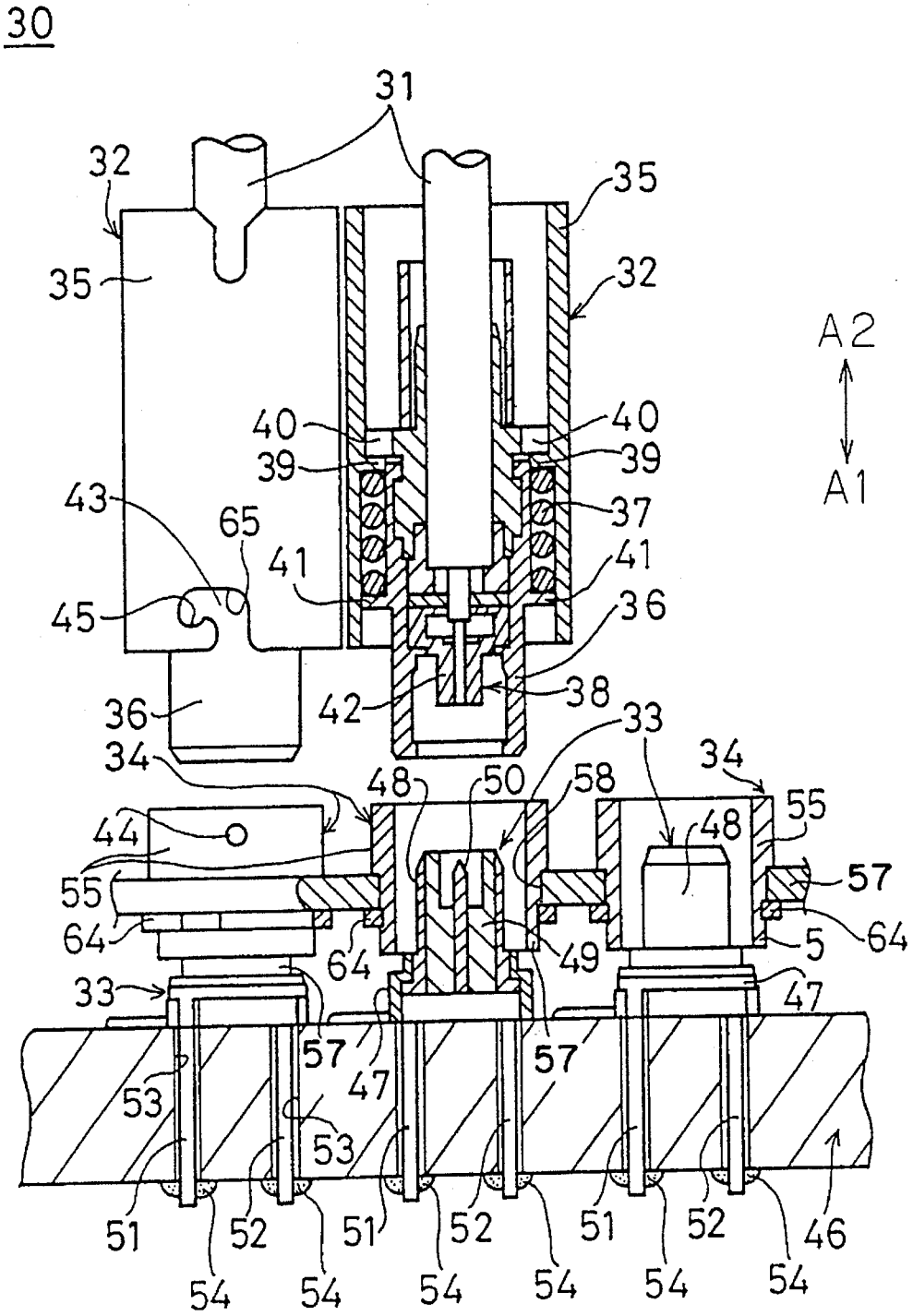
FIG. 2 shows a side view with a partial sectional view of a connector in an embodiment according to the present invention.
Figure 5:
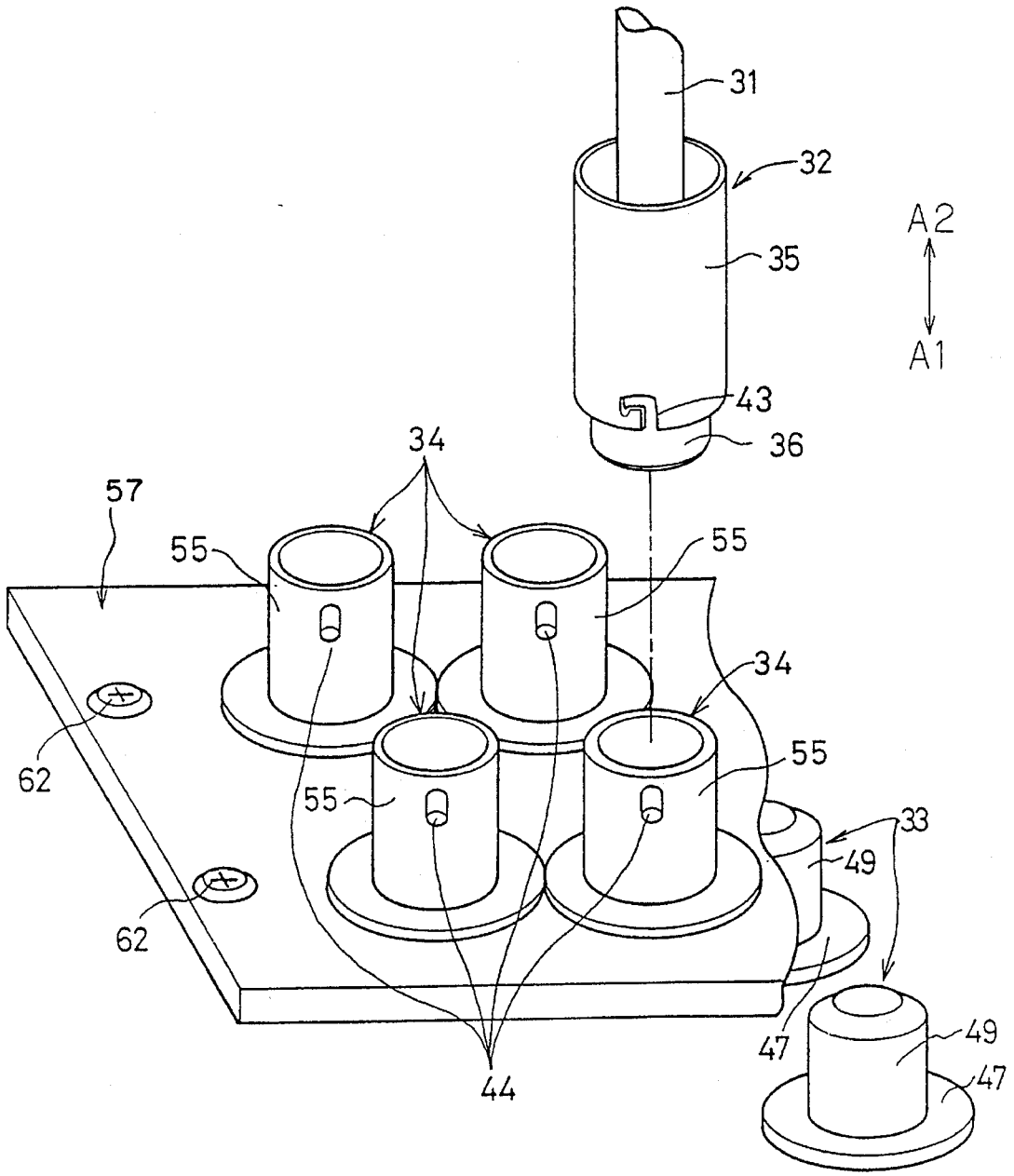
FIG. 5 shows a perspective view of essential elements of the connector shown in FIG. 2.

In order to set the plug 32 in the socket 33, the operator should insert the plug 32 in the A1 direction under the maintenance of the appropriate spatial relationship between the outer pipe 35 of the plug 32 and the engagement portion 55 of the fixed block 34 and the spatial relationship between the first locking portions 43 of the plug 32 and the second locking portions 44 of the fixed block 34 as shown in FIGS. 2 and 5.

As a result, the pin-type second locking portions 44 are inserted into the cavities of the first locking portions 43. Then, the operator slightly turns the outer pipe 35 after the second locking portions 44 come in contact with the top-right (in FIG. 2) edges 65 of the first locking portions 43. Thus, the second locking portions 44 are positioned at the fit positions 45 of the first locking portions 43.

Thus, the outer pipe 35 is inserted into and engaged with the engagement portion 55 and the inner pipe 36 is inserted into the metal shell 48 of the socket 33. When the inner pipe 36 is being inserted into the metal shell 48, the inner pipe 36 is pressed upward by the socket 33 as shown in FIG. 3 and the inner pipe 36 is thus moved with respect to the outer pipe 35 against the elastic force of the coil spring 37.

The upward (A2 direction) movement of the inner pipe 36 with respect to the outer pipe 35 causes the elastic force of the coil spring 37 to tend to press the outer pipe 35 in the A2 direction with respect to the inner pipe 36. Since the inner pipe 36 is held by the socket 33 as shown in FIG. 3, the elastic force of the coil spring 37 as a result causes the second locking portions 44 to be pressed onto the bottom ends of the first locking portions' fit positions 45, the engagement between the first and second locking portions 43 and 44 being thus ensured. Thus, the plug 32 is secured to the fixed block 34.

Figure 3:
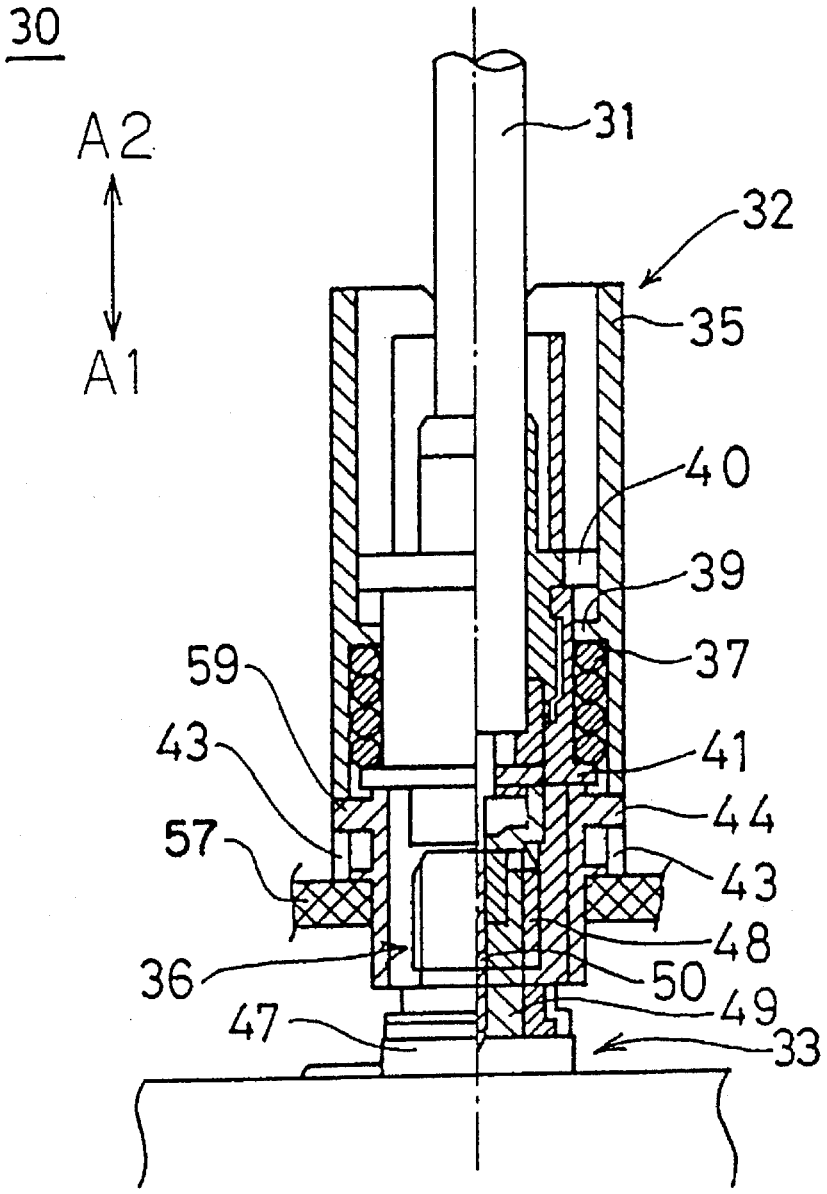
FIG. 3 shows a side view with a partial sectional view of a socket and plug having been inserted into the socket in the connector of FIG. 2.

Because the end of the socket 33 has been thus inserted into the inner pipe 36, the connection portion 42 of the metal shell 38 disposed in the inner pipe 36 is connected to the metal shell 48 disposed in the socket 33 as shown in FIG. 3. Thus, the electricity conducting element of the coaxial cable 31 is electrically connected to the connector pin 50 of the socket 33.

In FIG. 3, the plug 32 is connected to both the socket 33 and fixed block 34; the outer pipe 35 is fixed to the fixed block 34; and the inner pipe 36 containing the metal shell 38 is connected to the socket 33. The mechanical fixing of the plug 32 to the socket 33 is provided by the fixing of the outer pipe 35 to the fixed block 34 due to the engagement of the first and second locking portions 43 and 44. The electrical connection between the plug 32 and socket 33 is provided as a result of the inner pipe 36 being connected to the socket 33.

In this connecting state in the connector 30, a tension force applied to the cable 14 due to the self weight of the cable 14 and so forth is borne by the fixed block 34 via the outer pipe 35, the force being in turn borne by the circuit substrate 46 via the fixed plate 56. Thus, since direct application of such a tension force to the socket 33 can be prevented, the connection point construction between the inner pipe 36 and socket can be prevented from bearing an external force such as the cable tension force, a good electrical connection being thus ensured. Further, since the socket 33 can be thus prevented from bearing such an external force, the solder attachment of the terminal pins 51 and 52 to the circuit substrate 46 can be protected therefrom, the relevant solder attachment being thus prevented from being broken. Thus, the reliability of the connector 30 can be improved.

In an embodiment of the present invention, it is not always necessary to fix the fixed plate 56 to the circuit substrate 46 employed. Alternatively, a fixed plate may be fixed to a frame or the like of an electrical device which uses such a connector as the connector 30.

Further, the present invention is not limited to the above described embodiments, and variations and modifications may be made without departing from the scope of the present invention.

What is claimed is:

1. A connector comprising:

a plug including an inner pipe in which an external electric cable is installed; and an outer pipe supporting said inner pipe therein via an elastic member such that said inner pipe can move in said outer pipe in a withdrawal direction, said outer pipe being provided with a first locking portion for locking said plug to said socket;

a socket accompanied by an electric circuit, said inner pipe being inserted into said socket so that said electric circuit is electrically connected to said electric cable, the inserting being performed in an inserting direction opposite to said withdrawal direction; and a fixed block independently fixed to a base on which said socket is also independently fixed, so that an external force applied to said fixed block cannot be directly applied to said socket, said fixed block being provided with a second locking portion to be fitted to said first locking portion so that said plug is locked to said fixed block.

2. The connector according to claim 1, wherein:

said first locking portion comprises an approximately

L-shaped cutout; and said second locking portion comprises a projection.

3. The connector according to claim 1, wherein said elastic member applies an increasing force to prevent a fitting engagement between said first and second locking portions from being released, said elastic member increasing said force in a condition where said first locking portion is engaged with said second locking portion.

4. The connector according to claim 1, wherein said fixed block is fixed to said base via a fixed plate mounted on said base in an arrangement such that said fixed block faces said socket.

5. A connector comprising:

a socket accompanied by an electric circuit, an inner pipe of a plug being inserted into said socket so that said electric circuit is electrically connected to said electric cable, the inserting being performed in an inserting direction opposite to a withdrawal direction, said plug including said inner pipe in which an external electric cable is installed and an outer pipe supporting said inner pipe therein via an elastic member such that said inner pipe can move in said outer pipe in said withdrawal direction, said outer pipe being provided with a first locking portion for locking said plug to said socket; and a fixed block independently fixed to a base on which said socket is also independently fixed, so that an external force applied to said fixed block cannot be directly applied to said socket, said fixed block being provided with a second locking portion to be fitted to said first locking portion so that said plug is locked to said fixed block.

* * * * *